US005656135A

United States Patent [19]

Baker

[11] Patent Number: 5,656,135

[45] Date of Patent: Aug. 12, 1997

[54] MOLDED PRODUCT MANUFACTURING APPARATUS AND METHODS

[75] Inventor: Roger J. Baker, Portland, Me.

[73] Assignee: Moulded Fibre Technology, Inc., Westbrook, Me.

[21] Appl. No.: 19,172

[22] Filed: Feb. 16, 1993

[51] Int. Cl.[6] ..... D21J 3/00

[52] U.S. Cl. ..... 162/388; 162/410; 162/411

[58] Field of Search ..... 162/389, 410, 162/411, 416, 224, 397, 388, 230, 228, 262, 383; 198/861.5; 425/84, 85, 13 J, 139, 437, 190, 192 R

[56] References Cited

U.S. PATENT DOCUMENTS

| | | | |
|---|---|---|---|
| D. 143,042 | 11/1945 | Shepard | D58/16 |
| D. 150,758 | 8/1948 | De Reamer | D58/13 |
| D. 249,638 | 9/1978 | Chadbourne | D9/189 |
| D. 253,506 | 11/1979 | Vigue | D6/191 |
| D. 254,956 | 5/1980 | Gilley | D9/184 |
| D. 339,983 | 10/1993 | Breton et al. | D9/347 |
| 773,671 | 11/1904 | Palmer . | |
| 1,218,001 | 3/1917 | Rodwell | 162/410 |
| 1,409,591 | 3/1922 | Schavoir . | |
| 1,893,497 | 1/1933 | Gray | 162/224 |
| 2,564,729 | 8/1951 | Shepard | 206/65 |
| 2,575,192 | 11/1951 | Shephard | 229/2.5 |
| 2,704,268 | 3/1955 | Chaplin . | |
| 2,754,725 | 7/1956 | Emery | 162/410 |
| 2,774,473 | 12/1956 | Williams | 206/65 |
| 2,808,189 | 10/1957 | Williams | 229/14 |
| 2,813,652 | 11/1957 | Parsons | 217/26.5 |
| 2,996,118 | 8/1961 | Wells . | |
| 3,005,491 | 10/1961 | Leitzel . | |
| 3,028,065 | 4/1962 | Reifers | 229/2.5 |
| 3,129,866 | 4/1964 | Wade, Jr. | 229/2.5 |
| 3,132,991 | 5/1964 | Hornbostel et al. . | |
| 3,163,312 | 12/1964 | Chaplin | 217/26.5 |
| 3,205,128 | 9/1965 | Justus . | |

(List continued on next page.)

FOREIGN PATENT DOCUMENTS

| | | | |
|---|---|---|---|
| 658098 | 2/1963 | Canada | 162/410 |
| 1 064 867 | 10/1976 | Canada . | |
| 126 369 | 11/1973 | Denmark . | |
| 0225810 | 6/1987 | European Pat. Off. | 198/861.5 |

OTHER PUBLICATIONS

Operating Manual for Tomlinson "T" Pulp Plant (1990).
Operating Manual for Tomlinson Compact 200 Pulp Moulding Machine (1990).
"No Flash In The Pan" Financial Times, May 28, 1992.

(List continued on next page.)

*Primary Examiner*—Brenda A. Lamb
*Attorney, Agent, or Firm*—Sixbey Friedman Leedom & Ferguson; Daniel W. Sixbey; Evan R. Smith

[57] ABSTRACT

An improved flexible manufacturing process for making molded fiber products uses a molding machine provided with a large number of ports for mounting a variety of molds. Quick release mold attachments permit rapid changeover of production output. The molds used are designed to have a predetermined total height, and platen stops maintain this design separation during transfer of the molded product. An expanded stock chest is provided to permit a higher pulp usage rate. Separate positive air supply lines are provided for the different transfer mold sites. Using these separate lines, a novel air volume and flow control method is provided to control the volume of air applied to release products from transfer molds, permitting manufacture of a variety of complex structures. The air flow controls permit control of both the rate of flow and the duration of the selected rate of flow of positive pressure air, thus providing total volume control. A variable height conveyor is provided to receive molded structures and products dropped from the transfer molds of the upper platen to accommodate a variety of widths and depths of products in a particular run. Separate control of drying air flow in a multiple stage air dryer is provided to permit adjustment of the drying process to accommodate a variety of molded product configurations.

43 Claims, 8 Drawing Sheets

U.S. PATENT DOCUMENTS

| | | | |
|---|---|---|---|
| 3,243,096 | 3/1966 | Crabtree . | |
| 3,282,458 | 11/1966 | Rudd | 217/26.5 |
| 3,286,833 | 11/1966 | Chadbourne . | |
| 3,305,434 | 2/1967 | Bernier | 162/411 |
| 3,306,813 | 2/1967 | Reifers . | |
| 3,306,815 | 2/1967 | Mayne . | |
| 3,327,918 | 6/1967 | White | 229/2.5 |
| 3,343,702 | 9/1967 | Leitzel | 217/26.5 |
| 3,351,266 | 11/1967 | Reifers | 229/43 |
| 3,362,605 | 1/1968 | Bixler | 229/2.5 |
| 3,375,966 | 4/1968 | Crabtree | 229/2.5 |
| 3,477,564 | 11/1969 | Crabtree | 206/65 |
| 3,553,078 | 1/1971 | Aoki . | |
| 3,575,801 | 4/1971 | Friday | 162/389 |
| 3,647,132 | 3/1972 | Crabtree | 229/2.5 |
| 3,677,201 | 7/1972 | Chadbourne | 108/58 |
| 3,695,479 | 10/1972 | Crabtree | 217/26.5 |
| 3,700,096 | 10/1972 | Reifers . | |
| 3,702,100 | 11/1972 | Wharton | 108/58 |
| 3,708,084 | 1/1973 | Bixler et al. | 217/26.5 |
| 3,718,274 | 2/1973 | Reifers et al. . | |
| 3,732,976 | 5/1973 | Bessett et al. | 206/65 |
| 3,765,592 | 10/1973 | Chadbourne | 229/2.5 |
| 3,778,516 | 12/1973 | Cornelius | 206/46 |
| 3,793,138 | 2/1974 | Rohrer | 162/389 |
| 3,843,009 | 10/1974 | Emery | 217/26.5 |
| 3,850,793 | 11/1974 | Hornbostel et al. . | |
| 3,885,728 | 5/1975 | Gilley | 229/2.5 |
| 3,904,103 | 9/1975 | Chadbourne | 229/2.5 |
| 3,922,191 | 11/1975 | Witt et al. | 162/228 |
| 4,014,739 | 3/1977 | Granberg | 162/411 |
| 4,059,219 | 11/1977 | Reifers et al. | 229/2.5 |
| 4,087,040 | 5/1978 | Bessett et al. | 229/2.5 |
| 4,306,851 | 12/1981 | Thune . | |
| 4,394,214 | 7/1983 | Bixler et al. . | |
| 4,427,730 | 1/1984 | Robbins et al. | 428/156 |
| 4,448,344 | 5/1984 | Lord et al. | 229/2.5 |
| 4,480,781 | 11/1984 | Emery et al. . | |
| 4,742,916 | 5/1988 | Galea . | |
| 4,792,045 | 12/1988 | Creaden . | |
| 4,883,415 | 11/1989 | Zalvadori . | |
| 5,096,650 | 3/1992 | Renna . | |
| 5,244,094 | 9/1993 | Graff et al. | 206/564 |
| 5,316,173 | 5/1994 | Emery | 220/556 |
| 5,335,770 | 8/1994 | Baker et al. | 206/427 |

OTHER PUBLICATIONS

*Exhibit W,* Singh, Ph.D., S. Paul, et al., "*A Comparison Between Various Package Cushioning Materials*", IoPP Technical Journal, pp. 28–36 (Winter 1992).

Tomlinson Group Information; Brochures which disclose Tomlinson Emery pulp moulding machines of the general type modified in the present invention. (1990).

"Closing in on Alternative to Polystyrene Packaging" *Portland Press Herald,* Tuesday, Apr. 30, 1991.

"Maine Company Cushions Products in Mounlded Pulp" *Packaging,* Jul. 1991 Article.

MOLDED PRODUCT MANUFACTURING APPARATUS AND METHODS

FIELD OF THE INVENTION

The present invention relates to improved machinery, particularly adapted to form packaging and other structural shapes by molding fibers such as those contained in recycled paper products, and to manufacturing methods using such machinery.

BACKGROUND OF THE INVENTION

Plastic materials are predominantly used for interior package cushioning of shipped goods. Such plastic cushioning materials include a variety of polyethylene foams, moldable polyethylene copolymer foam, expanded polyethylene bead foam, styrene acrylonitrile copolymer foam, polystyrene foams, polyurethane foams, etc. Such plastic materials and plastic foams may be molded in place or molded to specific interior package cushioning structural shapes. The plastic may also be formed in pieces to provide loose fill, such as "styrofoam peanuts."

However, there are two major disadvantages associated with plastic cushioning materials and plastic interior package cushioning structures. First, disposable packaging is a major contributor to the nation's municipal solid waste. It is estimated that packaging constitutes approximately one third by volume of all municipal solid waste, and 8% of this amount is made up of cushioning materials. Second, plastic cushioning materials are generally neither biodegradable nor compostable and therefore remain a long-term component of the solid waste accumulation problem.

Furthermore, because of the nature of plastic molecules, plastic interior package cushioning structures have irreducible spring constant parameters that detract from product cushioning and protection from mechanical shock and vibration. Plastic foam materials may be inherently limited in the reduction that can be achieved for rebound, coefficient of restitution, and elasticity. As a result, the plastic cushioning materials may be implicated in resonance conditions which increase the shock amplification factor of the package system and link the shock acceleration, change of velocity, and displacement of the outer package with a product contained therein. Similarly, it has been found that these characteristics of plastic cushioning may contribute to vibration transmission and magnification under resonance conditions, and are an impediment to achieving critical structures for damping shocks and vibrations.

For these reasons, the inventor has determined that it would be desirable to provide novel and improved packaging structures, preferably constructed from molded paper fiber. These packaging structures are preferably constructed from recycled newsprint or other recycled paper products, and the structures are themselves recyclable. The novel and improved fiber packaging structures developed by the inventor are disclosed in the inventor's co-pending U.S. patent application Ser. No. 07/927,061 filed Aug. 6, 1992, and entitled "Molded Pulp Fiber Interior Package Cushioning Structures." The novel and improved packaging structures disclosed may be formed in complex shapes, including fibs, anti-hinge ribs, pods (singular or in rows), podded ribs, fillets, posts, shelves, scalloped or reinforced edges, stacking ribs and pods, crush ribs, suspension pockets, rib cages, and other complex structures.

Machines designed to form conventional paper fiber packaging structures, such as the fruit and egg cartons found in supermarkets, have been available for many years. One such machine available at a reasonable cost is a vertical motion-type low-volume vacuum molding machine made by Tomlinson's Ltd. of Rochdale, England. This machine is designed to continuously produce a desired molded fiber product.

U.S. Pat. No. 3,850,793 to Hornbostel et al. shows a molding machine for producing pulp products with a vacuum plenum divided into two chambers by a partition, with one mold mounted in each chamber. However, this machine is designed to produce a dashboard and is not adapted to form a variety of paper fiber packaging structures in the manner of the present invention.

U.S. Pat. No. 3,005,491 to Wells shows a high speed rotary type vacuum molding machine including an adapter plate secured to the periphery of a molding wheel which assists in vacuum distribution. However, the Wells design is intended only to secure a single mold.

U.S. Pat. No. 3,046,187 to Leitzel discloses a fruit tray molding machine which provides additional pressure ports and conduits to form aeration holes in the molded products.

U.S. Pat. No. 3,306,815 to Mayne describes a vertical action molding apparatus with a mold assemble suspended by a "flange connection" from a telescoping vacuum delivery pipe. U.S. Pat. No. 773,671 to Palmer shows a vertical motion molding device for pressure molding embossed panels from a pulp slurry. Final compression action of the molding frame is provided manually by a catch lever with a cam face engaging the mold bed. U.S. Pat. No. 1,409,591 to Schavoir shows the use of cam faced arms to lock together two mold sections of a press mold. U.S. Pat. No. 4,306,851 to Thune describes an injection molding apparatus for automotive-type batteries with a cam acting mechanism to lock internal molding cores into desired alignment with external mold cavities before injection. U.S. Pat. No. 4,883,415 to Salvadori discloses a tire molding machine with a rapid coupling and releasing bayonet mechanism for securing parts of the tire mold. U.S. Pat. No. 3,306,813 to Reffers shows a peripheral ring bolted to a mold to form a smooth peripheral edge surface on a molded article. None of these references appears to disclose securing a mold to a platen using a camming arrangement, or the provision of quick release mechanisms to provide rapid interchangeability of different molds on a platen.

Since the novel and improved packaging structures discussed above with reference to the inventor's co-pending application are more complex than common supermarket cartons, the complexity of the manufacturing process tends to be increased. Further, the natural uniformity Of eggs, for example, makes it possible to standardize their cartons, so that a machine may be dedicated to manufacturing the cartons and operated more or less continuously. However, according to the present invention, a variety of more complex packaging structures, as taught in the inventor's co-pending application, are provided for different products. The volume requirements for a given packaging structure may not justify the cost of a dedicated machine. Further, even if the machinery investment can be justified, there are substantial fixed costs in time and raw materials each time such machines are started. If the machine is used only intermittently to produce a relatively low volume output, the cost per unit is multiplied. For this reason, fiber molding machines are most efficient when operated to produce a nearly continuous output. Finally, it may be desirable in many cases to provide packaging output at a rate similar to the rate of products being produced on a parallel assembly line, so that the packaging for such products is provided "just in time" for the products to be boxed and shipped. In this way, the need for a large inventory of packaging material at the shipping site can be reduced.

For all of these reasons, it may not be desirable to dedicate a unique machine to each type of molded fiber product. Therefore, there is a need for a machine capable of manufacturing a variety of packaging shapes, which permits ready changeover of production to a new type of packaging shape without clearing and restarting the machine.

SUMMARY OF THE INVENTION

Therefore, it is a general object of this invention to provide a novel and improved apparatus for making molded fiber products which permits molding of complex packaging shapes.

Another general object of the present invention is to provide a novel and improved apparatus for making molded fiber products which permits rapid changeover to serially mold a variety of complex packaging shapes.

A more specific object of the present invention is to provide a novel and improved vacuum molding machine having a large number of mold sites to accommodate a variety of mold sizes and configurations.

A further object of the present invention is to provide a novel and improved vacuum molding machine in which the duration, pressure, and therefore the flow volume of air at each mold is individually controlled to permit precise control of transfer and ejection cycles to avoid damage to the products.

Another object of the present invention is to provide a novel and improved modification of a Tomlinson reciprocating low volume vacuum molding machine to facilitate production of a variety of molded fiber packaging products.

A further object of the present invention is to provide a novel and improved adapter plate for a vacuum molding machine which makes available a large number of ports for mounting molds.

Yet another object of the present invention is to provide a novel and improved quick release mold attachment mechanism for a vacuum molding machine to permit rapid changeover of production output by changing the molds in use.

Another object of the present invention is to provide a novel and improved platen stop mechanism for a reciprocating vacuum molding machine to provide a constant distance between the transfer molds and the forming molds during transfer of the formed product to the transfer molds.

Still another object of the present invention is to provide a novel and improved positive air supply system for a vacuum molding machine in which separate lines are provided for different transfer mold sites.

A further object of the present invention is to provide a novel and improved air volume and flow control method to control the volume of air applied to release products from transfer molds.

It is also an object of the present invention to provide a novel and improved air flow control for a vacuum molding machine to control both the volume rate of flow of air and the duration of the selected volume rate of flow of positive pressure air.

An additional object of the present invention is to provide a novel variable height conveyor system for a vacuum molding machine to receive molded interior package cushioning structures and other products dropped from transfer molds of an upper platen.

Another object of the present invention is to provide a novel and improved control of drying air flow in a multiple stage air dryer of a vacuum molding machine to permit adjustment of the drying process to accommodate a variety of molded product configurations.

Yet another object of the present invention is to provide a vacuum molding machine with an increased capacity pulp stock chest by providing an associated auxiliary chest.

Other objects of the present invention will become apparent to those skilled in the art upon review of the drawings, specification, and claims of the present application.

The objects are achieved in a preferred embodiment of the present invention by modifying a Tomlinson reciprocating low volume vacuum molding machine. Novel adapter plates are provided to provide a large number of ports available for mounting molds, and the adapter plates are provided with quick release mold attachments to permit rapid changeover of production output by changing the molds in use. Novel platen stops provide a constant distance between the transfer molds and the forming molds when these molds are in position to transfer the product from the forming molds to the transfer molds.

To accommodate simultaneous manufacture of a variety of complex structures, separate positive air supply lines are provided for the different transfer mold sites. Using these separate lines, a novel air volume and flow control method is provided to control the volume of air applied to release products from transfer molds. The air flow control both the volume rate of flow of air and the duration of the selected volume rate of flow of positive pressure air.

A variable height conveyor is provided to receive molded interior package cushioning structures and other products dropped from the transfer molds of the upper platen or pressure head. Because of the high moisture content and soft condition of the material at this stage in the process, molded interior package cushioning products are susceptible to damage and deformation if they strike the conveyor at too great a speed. The speed of striking the conveyor is determined by the distance between the transfer mold and the conveyor, over which the acceleration of gravity is effective. Because of the widely different widths or depths of different molded interior package cushioning products according to the present invention, the drop distance to the conveyor may vary considerably. Thus, according to the present invention, an adjustable height conveyor is used to accommodate the width or depth of products in a particular run.

The present invention also provides novel separate control of drying air flow in a multiple stage air dryer to permit adjustment of the drying process to accommodate a variety of molded product configurations. In addition, the Capacity of the pulp stock chest is increased by providing an auxiliary chest.

DETAILED DESCRIPTION OF A PREFERRED EMBODIMENT

The present invention is preferably constructed based on the essential structure of a Model TN1 vertical motion low volume vacuum molding machine, as manufactured by Tomlinson's Ltd. of Rochdale, England. This machine is designed primarily to mold egg crates and the like at relatively low volume and has been marketed as having an appropriate technology level for use in less developed countries. Such machines are relatively inexpensive in comparison with high volume rotary vacuum molding machines, which are also available in the marketplace.

Figure 1:
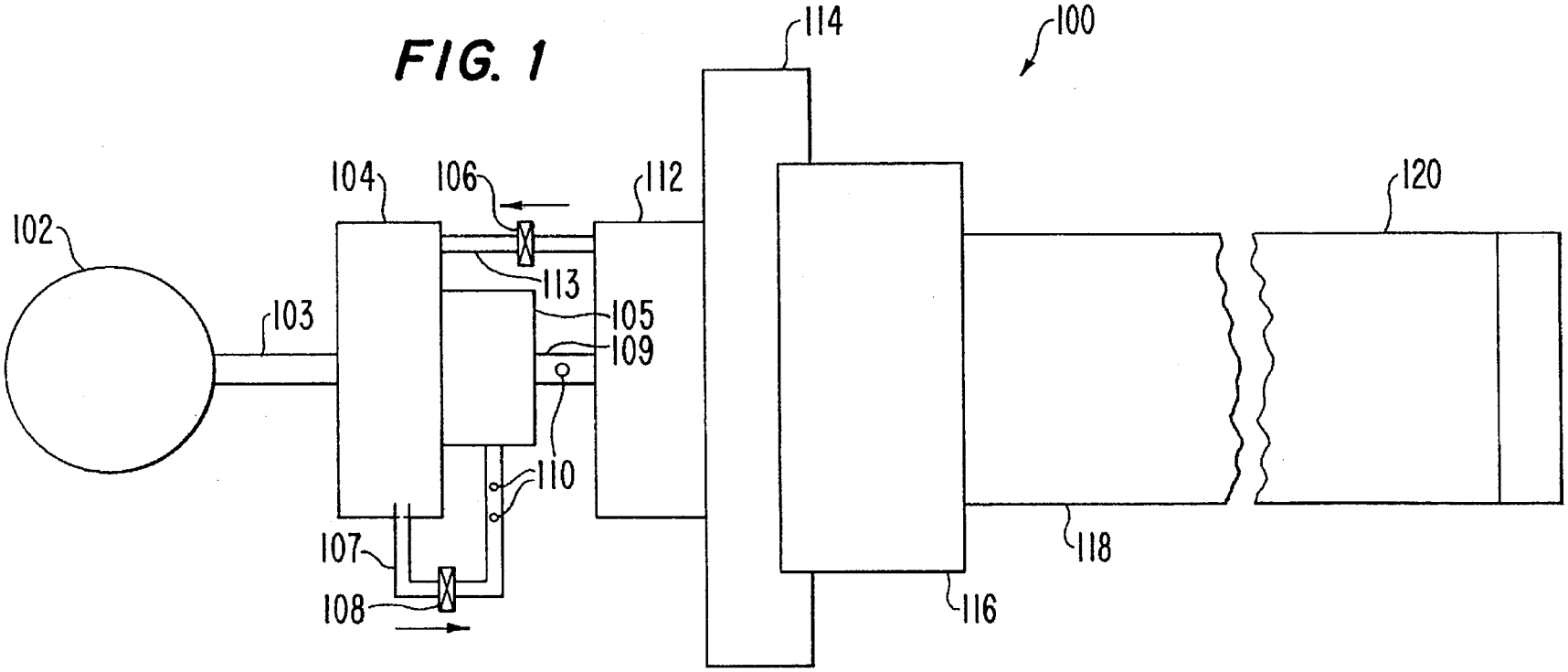
FIG. 1 is a block diagram of a Tomlinson pulp molding apparatus as used in the preferred embodiment of the present invention.

A block diagram of the apparatus of the present invention is shown in FIG. 1. As shown in FIG. 1, the apparatus 100 comprises pulper 102, water and pulp storage tanks 104, metering pumps 105, vacuum separator 112, forming station 116, conveyor 118 and five-stage dryer 120. Pulper 102 may be fed by a screw conveyor (not shown) or by any appropriate means for conveying raw material to pulper 102. Pulper 102 acts to reduce the raw material to a pulp, which is transferred to water and pulp storage tanks 104 through pipe 103. Metering pumps 105 draw the pulp material from storage tanks 104 through pipe 107 as needed. Flow through pipe 107 can be controlled by gate valve 108. The pulp is then transferred to vacuum separator 112 by metering pumps 105 through pipe 109. As can be seen in FIG. 1, pipes 107 and 109 contain additive feed nipples 110. Feed nipples 110 can be used when it is desirable to add further materials to the pulp. For example, it may be desirable to add a coloring agent or a binding agent to the pulp material through feed nipples 110.

The pulp mixture then enters vacuum separator 112 which serves to extract excess water from the pulp mixture. The extracted water is returned to storage tanks 104 through pipe 113, which contains a white water filter 106. The pulp mixture is then transferred under walkway 114 to forming station 116, which acts to mold the pulp into the desired forms. The operation of forming station 116 is described in more detail below in conjunction with FIG. 3. Once formed into a suitable shape, the molded pulp form is ejected onto conveyor 118 and carried through five-stage dryer 120 to dry and thereby harden-the molded pulp form.

Figure 2:
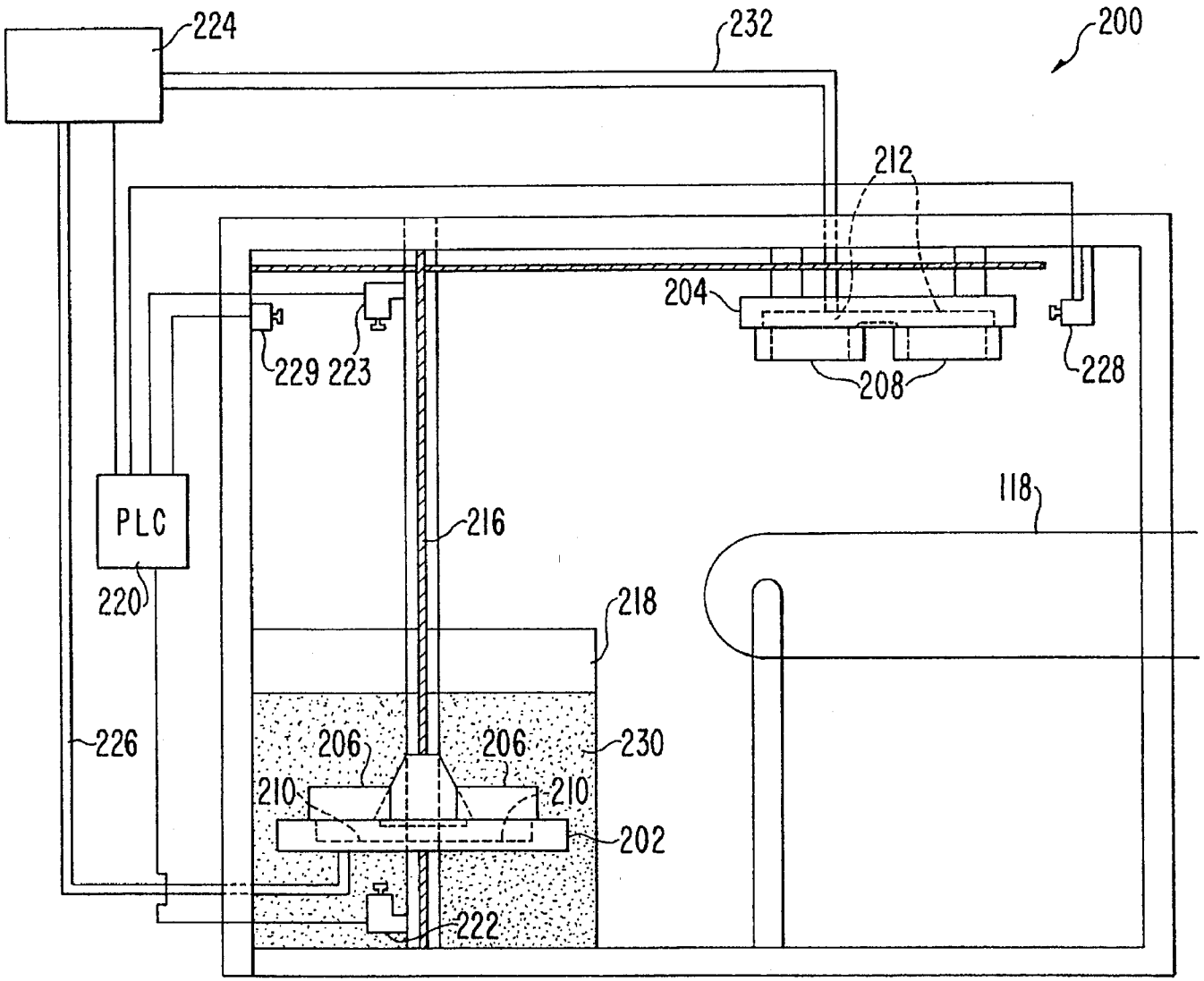
FIG. 2 (PRIOR ART)
FIG. 2 is a diagram of the prior art molding machine of the pulp molding apparatus of FIG. 1.

FIG. 2 shows a schematic diagram of a forming station 200 as currently used in a Tomlinson reciprocating low volume vacuum molding machine. As shown in FIG. 2, forming station 200 contains two vacuum platens, a lower platen 202 and an upper platen 204. These two platens, and up to four primary molds 206 and matching transfer molds 208 are attachable thereto. The mold sites 210 on the lower platen 202 and the mold sites 212 on the upper platen 204, each including a port for vacuum and pressurized air application, are aligned when the platens 202 and 204 are mated. Similarly, primary molds 206 and transfer molds 208 are aligned when platens 202 and 204 are mated. The primary molds 206 for molding products from the slurry of pulp fiber are secured to the mold sites 210 on the lower platen 202 and are generally male molds. The transfer molds 208 for transferring the molded pulp fiber products are secured to the mold sites 212 on the upper platen 204 and are generally female molds.

The lower platen 202 bearing primary molds 206 reciprocates in a vertical direction on drive chain 216 which lowers the primary molds 206 into slurry tank 218 containing a pulp fiber slurry 230. The time that primary molds 206 remain in slurry 230 is set by a programmable logic controller 220. Limit switches 222 and 223 control the range of reciprocating vertical movement of the lower platen 202. Also, limit switches 222 and 223 control the application of negative or positive air pressure provided by pressure source 224 through passage 226. The upper platen 204 reciprocates back and forth in a horizontal direction only, for the purpose of transferring molded structures to dryer conveyor 118. Limit switches 228 and 229 similarly control the range of horizontal motion and the application of negative and positive air pressure at the upper platen 204.

Passage 226 of the lower vacuum platen 202 may be selectively coupled through pressure source 224 to a vacuum line for applying a selected vacuum of negative air pressure. The same negative air pressure is distributed to each port and mold site 210 in this original machine. The vacuum is applied when the lower platen 202 reaches the lower limit switch 222. As noted above, the residence time of the primary molds 206 of the lower platen 202 in the pulp fiber slurry 230 from tank 218 is controlled by the programmable logic controller 220. Together, the magnitude of the vacuum applied and the residence time in the pulp fiber slurry determine the thickness or "gauge" of the molded product. After the lower platen 202 rises above the slurry 230 to the upper limit switch 223, there is a brief pause while further moisture is dram from the molded structure by applying vacuum through the passage 226. The lower platen 202 may also be selectively coupled to a positive air pressure line through passage 226 by appropriately controlling pressure source 224. The positive air pressure is similarly distributed to the port of each site 210 and thus to primary mold 206. Positive air pressure is applied through passage 226 to release the molded products from the respective primary molds 206.

At the upper limit of the range of travel of lower platen 202, the upper platen 204 is brought into position to form and receive the molded products as they are released from the primary molds 206. The upper vacuum platen 204 is similarly coupled through a passage 232 to pressure source 224, by which negative air pressure can be applied to the transfer mold sites 212. The molded fiber is "picked off" the primary molds 206 by vacuum applied to the proximate transfer mold sites 212. The upper platen 204 then travels in a horizontal direction to a position over dryer conveyor 118. At this location limit switch 228 is actuated and positive air pressure is applied by pressure source 224 through passage 232 to the transfer mold sites 212 to release the molded products and drop them onto conveyor 118. Conveyor 118 passes through a series of drying stages of dryer 120 (shown in FIG. 1) in which the molded fiber form is dried to form the completed products as described above.

Operational and structure modifications to this Tomlinson reciprocating low volume vacuum molding machine according to the present invention produce, at a reasonable cost, a new type of machine which is particularly adapted for molding of a variety of complex structures, particularly the interior package cushioning structures described in the inventor's co-pending U.S. patent application Ser. No. 07/927,061 fled Aug. 6, 1992, and entitled "Molded Pulp Fiber Interior Package Cushioning Structures," which is incorporated herein by reference. The invention provides both a novel and improved method of molding and transferring of molded pulp fiber products, and a novel and improved apparatus for forming molded fiber products, particularly for interior package cushioning use.

A preferred embodiment of the present invention will now be explained with reference to FIG. 3, which shows a schematic diagram of forming station 116 of the present invention. In a first aspect of the invention, the number of mold sites 210 and 212 are multiplied to permit the simultaneous molding of products of different size and complexity. This is accomplished in the preferred embodiment by mounting new adapter plates 306 on both the upper vacuum platen 204 and lower vacuum platen 202. These adapter plates 306, described in more detail below in association with FIG. 5, provide greater adaptability in mold mounting.

A further significant aspect of the present invention is the provision of separate air supply lines 312 and 313 to the different transfer mold sites 212 and primary mold sites 210 respectively. This air supply system is shown in more detail in FIG. 4, discussed below. As the machine operates, the upper platen 204 picks up molded products from molds 206, moves them to the dryer conveyor 118, and dispenses the molded products onto conveyor 118 by application of positive air pressure and air flow. Air volume control equipment 311 is provided to individually Control the rate of flow of air and the duration of flow of air applied for releasing the products at a plurality of mold sites 210 and 212 in a novel manner. Control of this air flow has been found to be critical for properly releasing products widely varying in size and complexity onto conveyor 118 without damage. The air volume control equipment 311 according to the present invention comprises flow control valves 314 and solenoid valves 316. Thus, controls are provided for both the rate of flow of air through control valves 314, and the duration of the selected rate of flow of the positive pressure air to each mold site through solenoid valves 316. The pressure of the air is also controllable by controlling the operation of pressure source 224. The two valves 314 and 316 operating together thus control the total volume of air delivered to a mold site 212, and a desired volume of air can thus be matched with the size and complexity of each molded product.

Specifically, separate air flow lines 312 are provided from the common pressure source 224. Within each of the separate air flow lines 312 there are provided separate solenoid valves 316 and flow control valves 314 which are connected to, and are separately controllable by, the machine's programmable logic controller 220. The programmable logic controller 220 is programmed to provide the appropriate rate of air flow and appropriate duration for the particular mold and product. Although only two air flow lines 312 are shown in FIG. 3 for clarity, the preferred embodiment of the invention would have four air flow branches.

The importance of this arrangement of separate positive air supply lines 312 to the regions of the upper vacuum platen 204, each with its own solenoid valve 316 and flow control valve 314, is that the rate of flow of air to the separate regions of the mold and the duration of the selected rate of flow of air, can be separately controlled at each mold site 212. This results in control of the total volume of air delivered to each mold site 212. The release of molded interior package cushioning structures from the transfer mold sites 212 on the upper platen 204 turns out to be very sensitive to these parameters of rate and duration of flow of air. For small products molded at a single mold site 212, a relatively small rate of flow of air and therefore a smaller total volume of air are appropriate for releasing the product to fall onto the conveyor without damage. For a large molded interior package cushioning product extending over four mold sites 212, for example, a larger rate of 1125X flow of air and therefore a larger total volume are necessary to release the molded product. Rate of flow of air, duration of flow of air, and total volume-of air must therefore be matched with molded product size and complexity. The objective is to release the molded product from the transfer mold evenly and without excessive force, allowing the product to fall by gravity onto the conveyor 118 without damage.

The appropriate levels are determined experimentally for each mold set used with the machine, and depend on the shape and complexity of the product produced by the mold set. An excessive flow rate to a particular mold site 212 may blow a hole in the wet product, or may rupture or deform complex ribs, pods, and fillets formed in the product. Too low a flow rate may similarly damage the product by stripping it incompletely, resulting in a fracture between a stripped portion and an adhering portion. In addition to adjusting the total volume of air provided, the duration of the air flow for a mold should be adjusted in conjunction with the flow rate to provide good stripping action without damaging the part. Some products may be better stripped by an extremely short, high pressure air blast. Other products are most effectively stripped by a lower pressure blast of longer duration.

To achieve this matching, the flow control valves 314 are first set in each of the first positive air supply lines 312 to permit passage of an appropriate flow rate of air to the respective mold sites 212. The air pressure remains the same throughout the system, for example in the range of 85 to 110 psi and typically 95 to 100 psi. The flow control valves 314 set the rate of flow to match the requirements for release of the respective molded products. The normally closed solenoid valves 316 are then automatically controlled by the programmable controller to open for a respective timed period, for example, ranging from 0.1 to 1 second, according to the volume of air required. The combination of the flow control valve 314 and the automated solenoid valve 316 control both the volume rate of flow and the time of duration of the flow. The two valves 314 and 316 operating together thus control the total volume of air delivered to a mold site 212, and the volume of air can be matched with the size and complexity of each molded product.

Similar air volume control equipment could optionally be used with lower platen 202 containing mold sites 210 and primary molds 206. As can be seen in FIG. 3, separate air supply lines 313 are connected to pressure source 224 through passage 226 and through flow control valves 320 and solenoid valves 322. Flow control valves 320 act to control the rate of air flow to mold sites 210 and solenoid valves 322 act to control the duration of air flow to mold sites 210. Together, flow control valves 320 and solenoid valves 322 act to control the total volume of air delivered to mold sites 210. Similar problems associated with transfer molds 208 (for example ripping or puncturing of the molded product) can occur during the transfer operation from primary molds 206 to transfer molds 208. For this reason, it is may be advantageous to maintain control over the air flow to mold sites 210. Both flow control valves 320 and solenoid valves 322 are connected to programmable logic controller 220 for automatic control. Alternatively, flow control valves 320 and solenoid valves 322 may be manually controlled.

Another novel feature of the present invention is a variable height conveyor 118 for receiving molded structures and products dropped from the transfer molds 208 of the upper platen 204. Because of the high moisture content and soft condition of the material when the molded product is ejected from transfer molds 208, the molded products are susceptible to damage and deformation if they strike the conveyor 118 at too great a speed. It is therefore desirable to position the conveyor 118 as dose to the molded products on the upper platen 204 as is reasonably possible. Because of the widely different widths or depths of different molded products, the drop distance may vary considerably. The height position of the upper platen 204 cannot be readily changed, and the reciprocating motion of the upper platen 204 is only in the horizontal direction. Preferably, the height of conveyor 118 is made variable, for example by providing adjuster 318. Adjuster 318 may be an automatic or manual jack, a pressure operated cylinder, an electrical solenoid, a mechanical turnbuckle, or any other mechanism that provides a means for adjusting the position of the conveyor 118 relative to the position of the molds 208 so that the conveyor is effectively positioned to receive the formed products. Although only one adjuster is shown, it may be desirable to employ two or more adjusters for altering the height of the conveyor 118.

Another improvement in the low volume vacuum molding machine is the separate control of drying air flow in the stages of the air dryer (shown in FIG. 1). The conveyor 118 passes through five stages of dryers coupled in a sequence. Each dryer incorporates an air flow system for a downward flow of air onto the conveyor and a return upward on the sides to a vent. The dryer air flows in the respective dryer stages are preferably separately controlled in the present invention, a feature not previously available in the Tomlinson vacuum molding machines. This is accomplished in a preferred embodiment by providing a variable baffle in the air passage to each dryer section. Each baffle can be adjusted to selectively restrict the volume of air being blown in that particular dryer stage. The baffles are manually adjustable in the preferred embodiment, although the baffles could also-be attached to servo motors and controlled automatically as part of the machine's operating program by the programmable logic controller 220.

Figure 3:
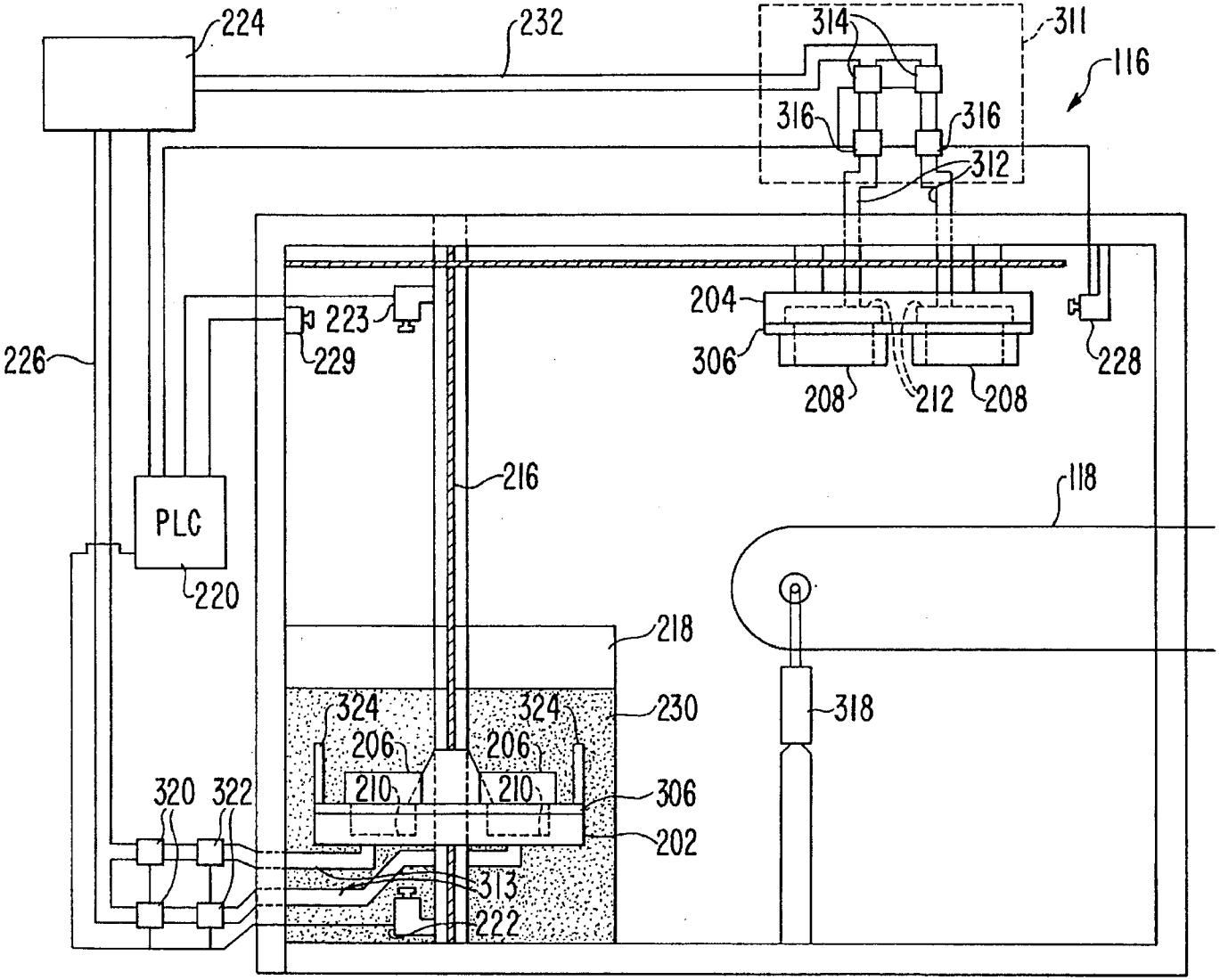
FIG. 3 is a diagram of an improved molding machine according to the present invention.

Another improvement in the low volume vacuum molding machine comprises the addition of die stops 324, shown in FIG. 3. When operating the unmodified Tomlinson reciprocating low volume vacuum molding machine, it was not necessary to accurately control the separation between the primary molds 206 and the transfer molds 208. This is so because the machine was primarily designed for the manufacture of egg cartons and the like. These products do not require dose tolerances in thickness. It has been found, however, that due to the consistency of the fiber pulp slurry, the die stops 324 are required when manufacturing more complex molded fiber packaging products according to the present invention, to insure that the specified product thickness is maintained. Without die stops 324, the primary molds 206 may approach too closely to transfer molds 208, causing excessive compression of the molded fiber product. To alleviate this problem, die stops 324 are employed to stop the upward travel of lower platen 202 at an appropriate distance from upper platen 204. In the preferred embodiment of the present invention, the die stops 324 are 5.875 inches high, thereby insuring a minimum separation between lower platen 202 and upper platen 204 of 5.785 inches. Further details of the construction of die stops 324 are discussed below in connection with FIG. 7.

Figure 4:
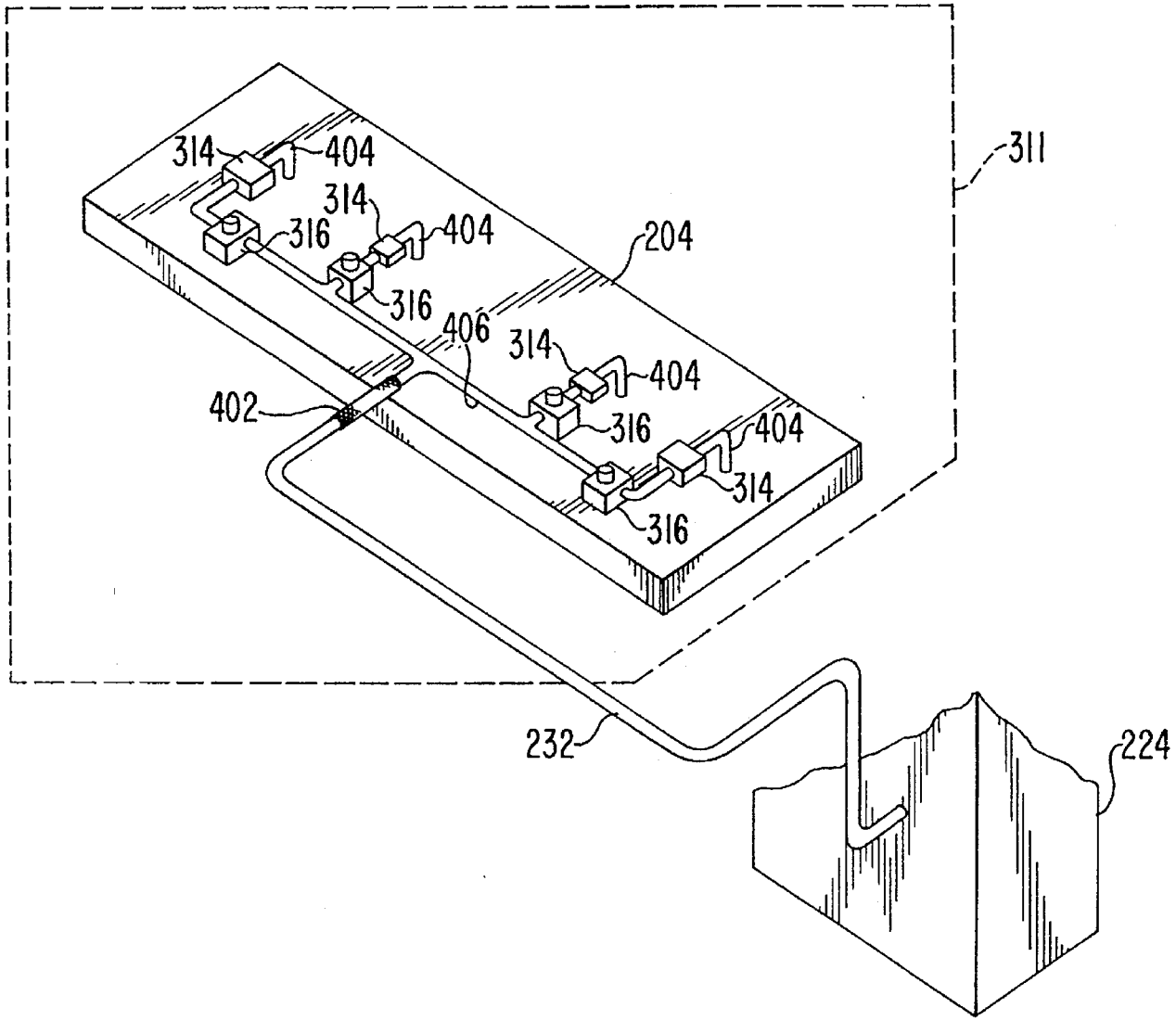
FIG. 4 is an assembly drawing of the inventive upper platen air flow apparatus shown in FIG. 3.

Referring next to FIG. 4, an assembly drawing of the air volume control equipment 311 is shown. As can be seen in FIG. 4, equipment 311 comprises rate control valves 314, solenoid valves 316, flexible pipe 402, common supply pipe 406 and inlet pipes 404. Rate control valves 314, solenoid valves 316, and inlet pipes 404 are arranged in spaced apart relationship on upper platen 204. This spacing allows varying pressure to be applied to different mold sites 212 depending on the molded product being produced. Pressure source 224 supplies air through passage 232 to flexible pipe 402. Flexible pipe 402 in turn supplies air to common supply pipe 406 fastened to upper platen 204. Flexible pipe 402 is provided to compensate for lateral movement of upper platen 204 during the molding process. While four inlet pipes are shown here, more or less could be used as desired for a given machine depending on the number of different products to be molded simultaneously.

Figure 5A:
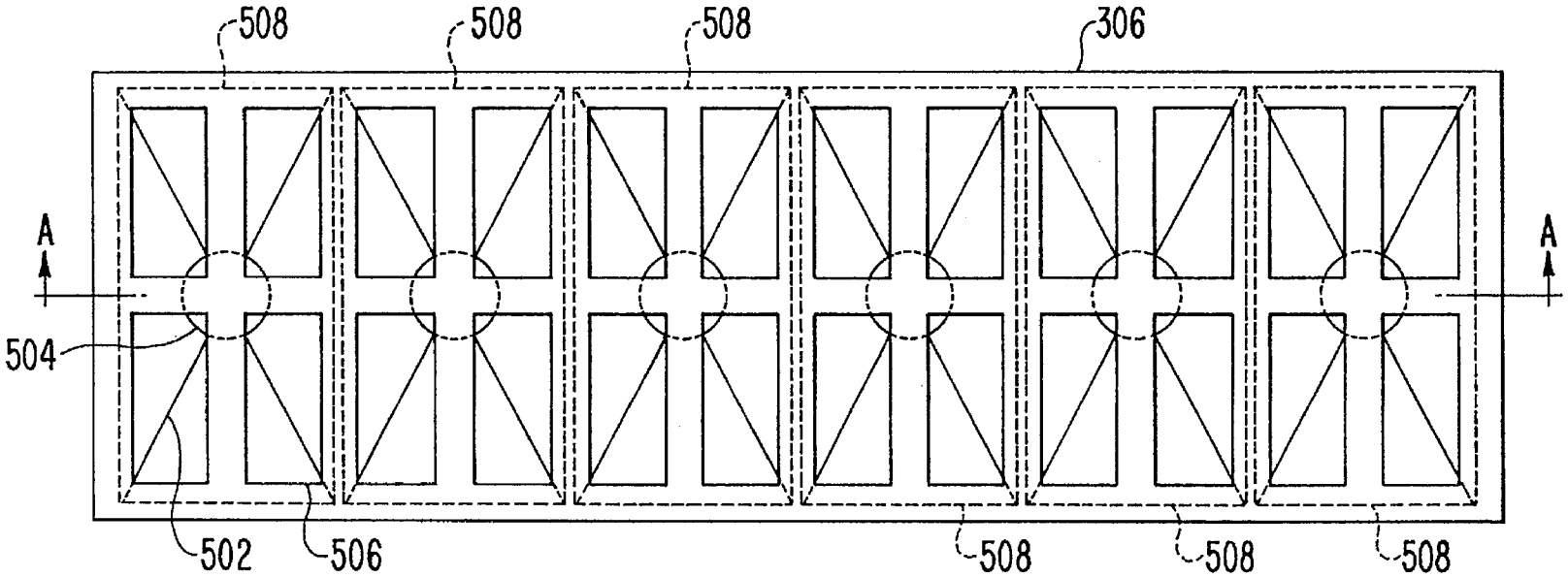
FIG. 5*a* is a view of an adapter plate according to the present invention for adapting a prior art molding machine for use with a plurality of complex and varying molds.
Figure 5B:
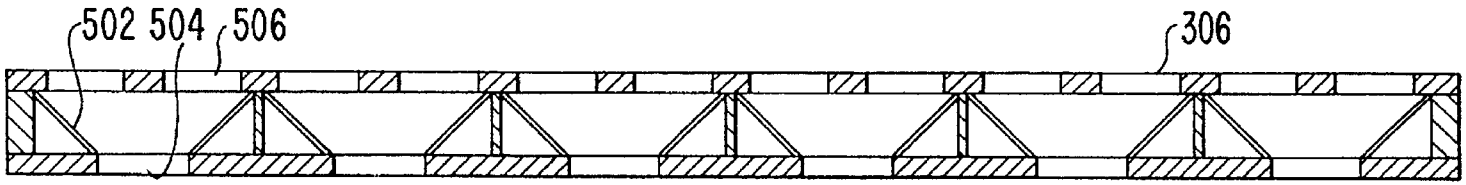
FIG. 5*b* is a side sectional view of the adaptor plate of FIG. 5*a;*
Figure 6A:
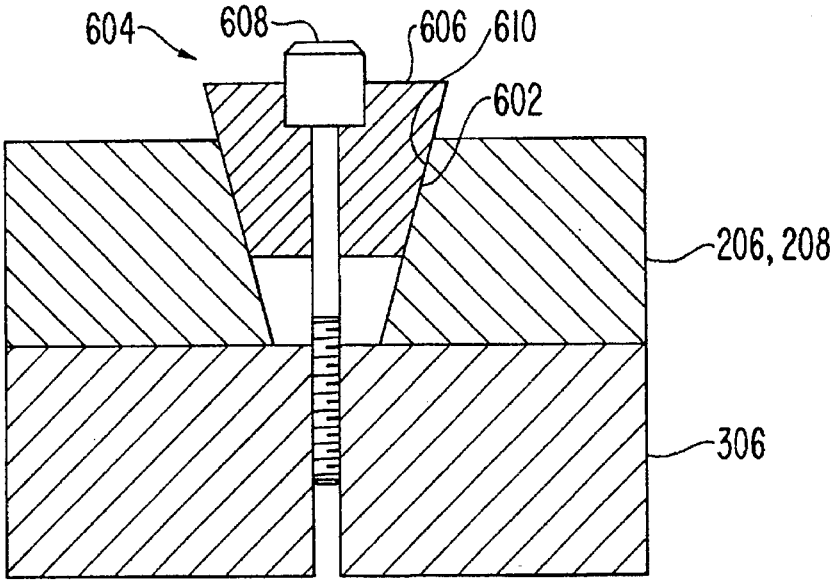
FIG. 6*a* is a sectional view showing a quick release cam lock according to the present invention.
Figure 6B:
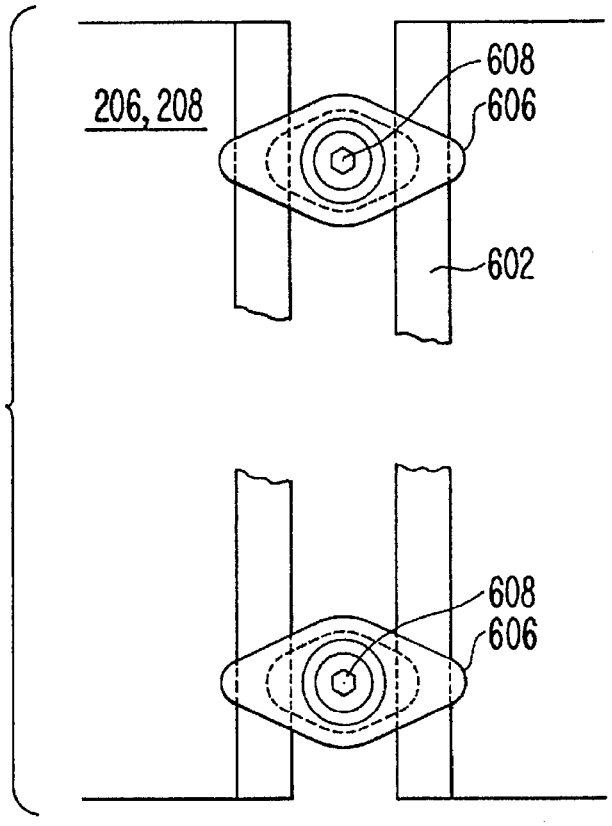
FIG. 6*b* is a top view showing the installation of a mold using two such cam locks.

Referring next to FIGS. 5A and 5B, a detailed view of an adaptor plate 306 is shown. FIG. 5A shows a top view of adaptor plate 306 and FIG. 5B shows a sectional view of adaptor plate 306 taken along the section line A—A in FIG. 5A. Preferably, the adaptor plates 306 are configured according to the diagram of FIG. 5 and multiply the number of each of vacuum mold sites 210 and 212 from four to twenty-four.

As can be seen in FIGS. 5A and 5B, adaptor plates 306 contain baffles 502, air inlets 504, and pressure openings 506. As shown in FIG. 5A, each adaptor plate 306 may be constructed of six modules 508. Each module 508 has four air baffles 502, one air inlet 504, and four pressure openings 506. The arrangement of air baffles 502 and pressure openings 506 act to distribute the air flow from pressure inlet 504 to the molds sites 210 and 212.

As shown in FIG. *6a*, the mold sites 210 and 212 thus created on adaptor plates 306 are preferably provided with quick-release interchangeable mountings such as cam locking mechanism 604, which permits quickly changing the mold 206 or 208 used at any particular mold site 210 and 212. A single mold 206 or 208 may also be attached to a plurality of mold sites 210 and 212 if a larger or particularly complex product is to be formed, and the quick release mountings are therefore designed to permit attachment of a larger mold across two or more mold sites. As shown in the drawing figure, the molds 206, 208 preferably have angled camming surfaces 602 machined into their sides, which cooperate with a quick release cam locking mechanism 604 which attaches the mold 206, 208 to adaptor plate 306. The cam locking mechanism 604 includes cam 606 which is rotatably attached about Allen bolt 608. If Alien bolt 608 is loosened slightly, for example approximately one turn, cam 606 may be rotated ninety degrees with respect to mold 206 or 208, thus releasing mold 206, 208 from adaptor plate 306, leaving cam locking mechanism 604 attached to adaptor plate 306 in position to receive another mold 206, 208. To install a mold, the mold 206, 208 is placed in position against adaptor plate 306 and cams 606 are rotated ninety degrees. The Allen bolts 608 are then tightened to force camming surfaces 610 of cams 606 firmly against camming surfaces 602 of mold 206 or 208.

FIG. *6b* is a top view showing two cam locking mechanisms 604 holding a mold 206, 208 in position against adaptor plate 306.

Figure 7:
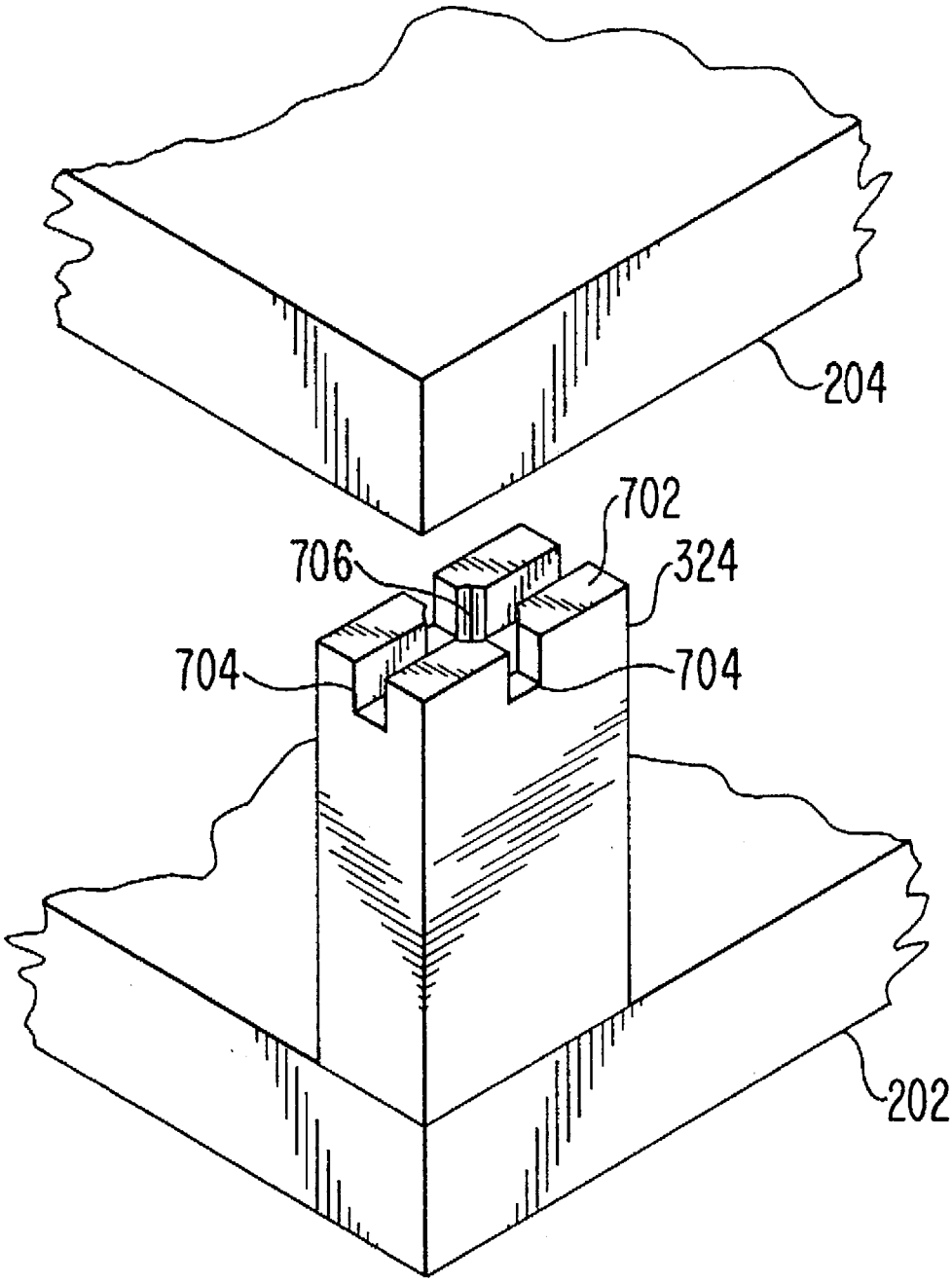
FIG. 7 is an assembly drawing showing a die stop according to the present invention.

FIG. 7 shows a detailed view of a preferred embodiment of the die stop 324 which was previously discussed with reference to FIG. 3. Die stop 324 may be made from stainless steel or other suitable material and is mounted to lower platen 202 using, for example, bolts. FIG. 7 depicts one corner of lower platen 202. Each of four comers of lower platen 202 have a die stop 324 in the preferred embodiment of the invention.

As discussed above, the purpose of the die stops 324 is to prevent the lower platen 202 from approaching the upper platen 204 too closely, resulting in over compression of the molded fiber product. Die stop 324 serves to ensure that lower platen 202 and upper platen 204 maintain a minimum separation of, for example, 5.875 inches. Due to the consistency of the pulp slurry used in the present invention, it has been found that a large flat surface on the top 702 of die stop 324 can result in a layer of pulp material being caught between the top 702 and the upper platen 204, preventing top 702 of die stop 324 from contacting upper platen 204. This excess separation between the lower platen 202 and the upper platen 204 may result in molded fiber products of substantially varying thicknesses, and may also result in deformation of complex formed packaging shapes such as pods, ribs, etc. Repeatable relative positioning of the molds 206, 208 is important to the formation of dimensionally consistent packaging materials according to the present invention. For this reason, it is desirable to insure that the top 702 of die stop 324 will seat firmly against upper platen 204 without interference from some varying amount of pulp material caught therebetween. This is accomplished in the present invention through the use of drainage slots 704, which provide a means for removal of pulp material coating the top 702 of the die stop 324, thus ensuring firm contact between die stop 324 and the upper platen 204. Slots 704 may be cut both vertically and horizontally in the top 702 of die stop 324 as shown. Additionally, an enlarged central drainage area 706 is provided to further reduce the separation occurring from excess pulp material. Depending on the surface area of top 702, it may be desirable to provide either more or fewer slots and drainage areas.

In operation, as lower platen 202, and therefore die stop 324, approach upper platen 204, excess slurry material will be forced from between top 702 and upper platen 204, through drainage slots 704, and back into slurry tank 218 (shown in FIG. 3). The drainage slots 704 effectively reduce the integral of D * dA for the die stop 324, where A is a small area on the top 702 and D is the distance of the center of the area A to the nearest edge of top 702 over which pulp material can flow under pressure. As a result of this reduction, any pulp material residing on the top 702 more easily flows out from between the top 702 and the upper platen 204. Thus, die stop 324 seats firmly against upper platen 204, and the thickness of the molded products produced is correct and highly consistent.

Figure 8:
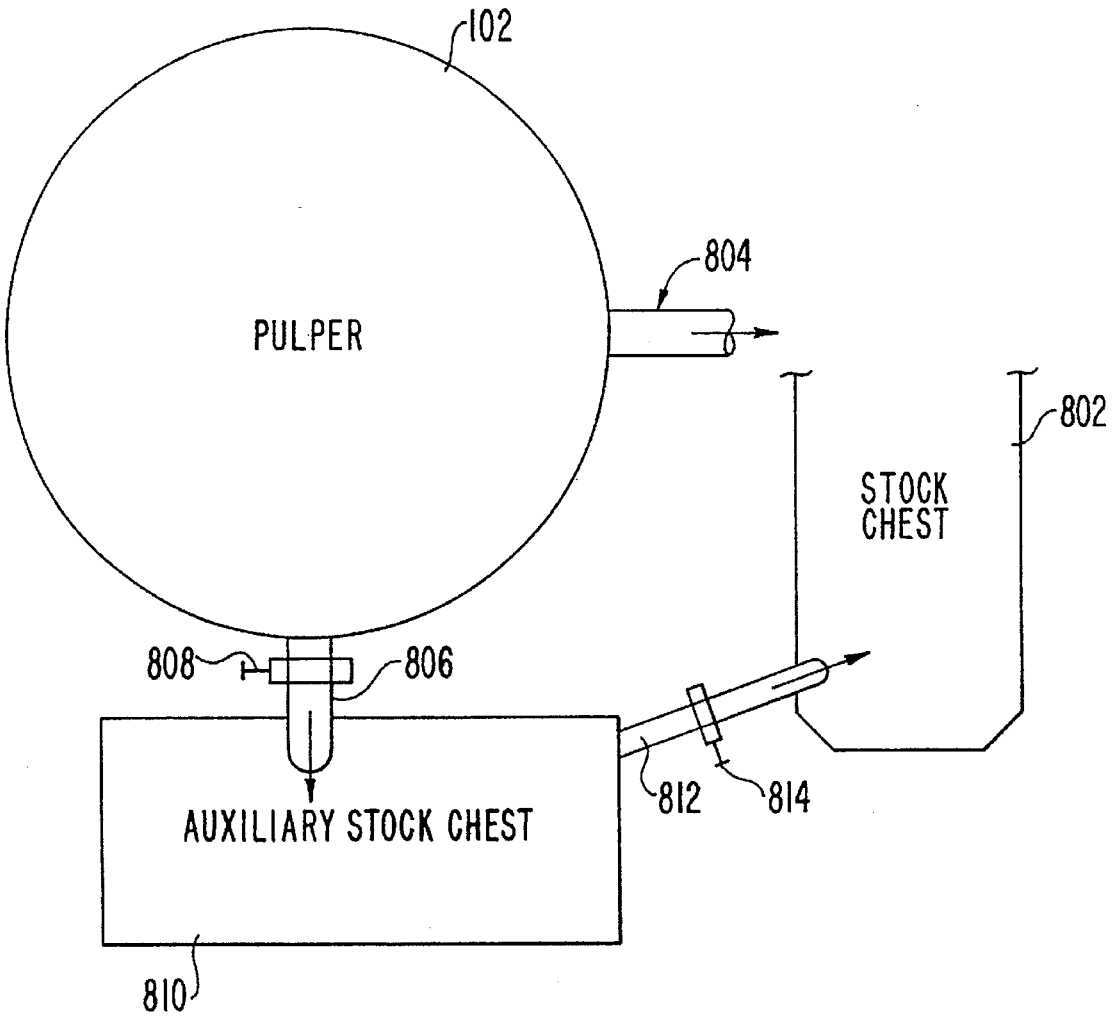
FIG. 8 is a plan view of apparatus for expanding the stock chest capacity according to the present invention.

FIG. 8 is a top view of a modification to the stock chest of the apparatus 100. When the Tomlinson machine is used to make eggcrates according to its original design, the amount of pulp material required is constant and may be provided by the existing pulper 102 feeding stock chest 802 through existing feed line 804. However, in the present invention, a large variety of molded products of varying sizes may be produced. For this reason, the usage rate of pulp is more variable when the machine is modified according to the present invention. Therefore, it may be necessary in some circumstances to have a larger reservoir of stock for feeding to the molding machine. In a preferred embodiment, an additional four inch feed line 806 with a gate valve 808 is provided from pulper 102 to an auxiliary stock chest 810. Auxiliary stock chest 810 preferably has a nominal capacity of 42 cubic feet. Auxiliary stock chest 810 is connected to stock chest 802 by a three inch feed line 812 having a gate valve 814. By appropriately controlling gate valves 808 and 814, which may be either manually or automatically controlled, the operator can fill auxiliary stock chest 810 from the pulper 102 and can also fill stock chest 802 from auxiliary stock chest 810. In this way, it is possible to "bank" a larger amount of pulp stock produced by pulper 102 for production of products that use a large quantity of pulp.

Thus, there has been disclosed herein an improved vacuum molding machine and methods for making and using such a machine. It will be apparent to those skilled in the art that various modifications and variations can be made in the systems of the present invention without departing from the scope or spirit of the invention.

What is claimed is:

1. A vacuum molding apparatus for pulp products comprising:

molding platen means for providing a plurality of forming mold attachment sites to receive one or more forming molds, and for introducing wet pulp material to said forming molds to mold formed products;

transfer platen means for providing a plurality of transfer mold attachment sites to receive one or mote transfer molds corresponding to said forming molds, and for transferring said formed products from said forming molds for subsequent processing;

air pressure source means operably connected to each transfer mold attachment site of said transfer platen means and to each forming mold attachment site of said molding platen means to selectively create an air pressure at said transfer mold attachment sites and said forming mold attachment sites, including means for creating a negative air pressure at said forming mold attachment site to attract said wet pulp material to said forming mold, and means for creating a negative air pressure at said transfer mold attachment site to remove said formed products from said forming mold;

valve means connected between said air pressure source means and a plurality of said transfer mold attachment sites for varying flow rate and flow duration of air created at said plurality of transfer mold attachment sites by said air pressure of said air pressure source means; and control means connected to said valve means for individually and differentially controlling flow duration and volume flow rate of air flow created by said negative air pressure at a plurality of said transfer mold attachment sites to provide different desired flow durations and flow rates of air at said transfer mold attachment sites depending on characteristics of the formed product at each said transfer mold attachment site.

2. The vacuum molding apparatus of claim 1 further including drying means situated proximate to the transfer platen means for receiving said formed products from said transfer platen means and for drying said formed products.

3. The vacuum molding apparatus of claim 2 wherein said drying means comprises a plurality of sequentially arranged air drying stages through which the formed products pass, with the air drying stages having independently controllable air flow volumes.

4. The vacuum molding apparatus of claim 2 wherein said drying means comprises conveyor means for continuously receiving said formed products from said transfer molds, the vertical positioning of said conveyor means being adjustable to vary a distance which said formed products drop from said transfer molds to said conveyor means.

5. The apparatus of claim 2 wherein said drying means further comprises a conveyor means for carrying said formed products through said drying means and a plurality of baffle control means for selectively directing drying air flow to provide different air flow volumes to different parts of the conveyor to accommodate different formed product configurations.

6. The vacuum molding apparatus of claim 1 wherein said transfer mold attachment sites and said forming mold attachment sites are each provided with quick release attachment means for attaching said transfer and forming molds respectively, whereby a formed product output of said apparatus may be changed at any time by replacing the respective molds at said attachment sites with molds for different formed products.

7. The vacuum molding apparatus of claim 1 wherein said forming and transfer mold attachment sites each comprise a pressure port and the size of said transfer and forming molds varies such that each said transfer mold and each said forming mold occupies one or more of said pressure ports.

8. The vacuum molding apparatus of claim 1 wherein said control means comprises a programmable logic controller for automatically controlling said air flow rate and flow duration varying function of said valve means.

9. The vacuum molding apparatus of claim 1 wherein said molding platen means and said transfer platen means are indexed into proximity with each other in a transfer position for transferring said formed products from said forming molds to said transfer molds, and further comprising index stop means for establishing a predetermined standard spacing between said transfer platen means and said molding platen means in said transfer position.

10. The vacuum molding apparatus of claim 9 wherein said transfer molds and forming molds are constructed in mating pairs and wherein the sum of thicknesses of a forming mold, its mating transfer mold, and a desired formed product thickness is equal to said predetermined standard spacing.

11. The vacuum molding apparatus of claim 9 wherein said index stop means comprises at least one stop part extending from one of said molding platen means and said transfer platen means to contact the other of said molding platen means and said transfer platen means in said transfer position.

12. The vacuum molding apparatus of claim 11 wherein the end of said stop part is providing with distribution channel means for preventing said wet pulp material from interfering with said contact between said stop part and said platen means in said transfer position.

13. The apparatus of claim 1 wherein said air pressure source means comprises means for creating a positive air pressure at said transfer mold attachment sites to remove said formed products from said transfer molds.

14. The apparatus of claim 13 wherein said control means comprises means for individually controlling duration and rate of positive air flow at each transfer mold attachment site.

15. The apparatus of claim 1 wherein said air pressure source means comprises means for creating a positive air pressure at said forming mold attachment sites to remove said formed products from said forming molds.

16. The apparatus of claim 15 wherein said valve means is further connected between said air pressure source means and a plurality of said forming mold attachment sites, and wherein said control means comprises means for individually controlling duration and rate of positive air flow at each forming mold attachment site.

17. The apparatus of claim 16 wherein said control means comprises means for individually controlling duration and rate of vacuum air flow at each forming mold attachment site.

18. The apparatus means comprises means for individually controlling duration and rate of vacuum air flow at each forming mold attachment site.

19. An apparatus for molding pulp products, comprising:

molding platen means for receiving a plurality of forming molds of differing size and for introducing wet pulp material to said forming molds to mold formed products, said molding platen means providing at least twelve forming mold attachment sites, each said attachment site comprising a pressure port, where the size of said forming molds varies such that each said forming mold occupies one or more of said pressure ports and at least one said forming mold occupies two or more pressure ports;

transfer platen means for receiving a plurality of transfer molds of differing size corresponding to said forming molds and for transferring said formed products from said forming molds for subsequent processing, said transfer platen means providing at least twelve transfer mold attachment sites, each said attachment site comprising a pressure port, where the size of said transfer molds varies such that each said transfer mold occupies one or more of said pressure ports and at least one said transfer mold occupies two or more pressure ports;

air pressure source means operably connected to each transfer mold attachment site of said transfer platen means to selectively create an air pressure at said transfer mold attachment sites whereby said formed products are transferred from said forming molds; and quick release attachment means at each forming and transfer mold attachment site for attaching said transfer and forming molds respectively, whereby a formed product output of said apparatus may be changed at any time by replacing the respective molds at said attachment sites with molds of different sizes.

20. The apparatus of claim 19 further comprising:

valve means connected between said air pressure source means and a plurality of said transfer mold attachment sites for varying flow rate and flow duration of air applied to said plurality of transfer mold attachment sites by said air pressure source means; and control means connected to said valve means for differentially controlling flow duration and volume flow rate of air created at a plurality of said transfer mold attachment sites by said air pressure source means to provide different desired flow durations and flow rates of air at said transfer mold attachment sites depending on characteristics of the formed product at said transfer mold attachment sites.

21. The apparatus of claim 20 wherein said control means comprises a programmable logic controller for automatically controlling said air flow rate and flow duration varying function of said valve means.

22. The apparatus of claim 19 further including drying means situated proximate to the transfer platen means for receiving said formed products from said transfer platen means and for drying said formed products.

23. The apparatus of claim 22 wherein said drying means further comprises a conveyor means for carrying said formed products through said drying means and a plurality of baffle control means for selectively directing drying air flow to provide different air flow volumes to different parts of the conveyor to accommodate different formed product configurations.

24. The apparatus of claim 22 wherein said drying means comprises a plurality of sequentially arranged air drying stages through which the formed products pass, with the air drying stages having independently controllable air flow volumes.

25. The apparatus of claim 22 wherein said drying means comprises conveyor means for continuously receiving said formed products from said transfer molds, the vertical positioning of said conveyor means being adjustable to vary a distance which said formed products drop from said transfer molds to said conveyor means.

26. The apparatus of claim 19 wherein said molding platen means and said transfer platen means are indexed into proximity with each other in a transfer position for transferring said formed products from said forming molds to said transfer molds, and further comprising index stop means for establishing a predetermined standard spacing between said transfer platen means and said molding platen means in said transfer position.

27. The apparatus of claim 26 wherein said index stop means comprises at least one stop part extending from one of said molding platen means and said transfer platen means to contact the other of said molding platen means and said transfer platen means in said transfer position.

28. The vacuum molding apparatus of claim 27 wherein the end of said stop part is providing with distribution channel means for preventing said wet pulp material from interfering with said contact between said stop part and said platen means in said transfer position.

29. The vacuum molding apparatus of claim 26 wherein said transfer molds and forming molds are constructed in mating pairs and wherein the sum of thicknesses of a forming mold, its mating transfer mold, and a desired formed product thickness is equal to said predetermined standard spacing.

30. A vacuum molding apparatus for pulp products comprising:

molding platen means for providing a plurality of forming mold attachment sites to receive one or more forming molds, and for introducing wet pulp material to said forming molds to mold formed products;

transfer platen means for providing a plurality of transfer mold attachment sites to receive one or more transfer molds corresponding to said forming molds, and for transferring said formed products from said forming molds for subsequent processing;

air pressure source means operably connected to said plurality of forming mold attachment sites of said molding platen means and said transfer mold attachment sites of said transfer platen means for selectively creating an air pressure at said forming mold attachment sites and said transfer mold attachment sites, including means for creating a negative air pressure at said forming mold attachment sites to attract said wet pulp material to said forming mold and further including means for creating a positive air pressure at said transfer mold attachment sites to remove said formed products from said transfer molds; and control means connected between said air pressure source means and said plurality of transfer mold attachment sites for individually and differentially controlling the duration and volume flow rate of air flow induced by said positive air pressure applied to said transfer mold attachment sites depending on characteristics of said formed product at each said transfer mold attachment site.

31. The apparatus of claim 30 wherein said control means comprises means for individually controlling duration and rate of vacuum air flow at said plurality of forming mold attachment sites.

32. The apparatus of claim 30 wherein said air pressure source means comprises means for creating a negative air pressure at said transfer mold attachment sites to remove said formed products from said forming mold.

33. The apparatus of claim 32 wherein said control means comprises means for individually controlling duration and rate of vacuum air flow at said plurality of transfer mold attachment sites.

34. The apparatus of claim 30 wherein said transfer mold attachment sites and said forming mold attachment sites are provided with quick release attachment means for attaching said transfer and forming molds respectively, whereby a formed product output of said apparatus may be changed at any time by replacing the respective molds at said forming mold attachment sites and said transfer mold attachment sites with molds for different formed products.

35. The vacuum molding apparatus of claim 30 wherein said forming and transfer mold attachment sites each comprise a pressure port and the size of said transfer and forming molds varies such that each said transfer mold and each said forming mold occupies one or more of said pressure ports and at least one such transfer mold occupies a plurality of pressure ports.

36. The apparatus of claim 30 whereto said control means comprises a programmable logic controller for automatically controlling said duration and volume flow rate varying function of said control means.

37. The apparatus of claim 30 wherein said molding platen means and said transfer platen means are indexed into proximity with each other in a transfer position for transferring said formed products from said forming molds to said transfer molds, and further comprising index stop means for establishing a predetermined standard spacing between said transfer platen means and said molding platen means in said transfer position.

38. The apparatus of claim 37 wherein said index stop means comprises at least one stop part extending from one of said molding platen means and said transfer platen means to contact the other of said molding platen means and said transfer platen means in said transfer position.

39. The apparatus of claim 38 wherein the end of said stop part is providing with distribution channel means for preventing said wet pulp material from interfering with said contact between said stop part and said platen means in said transfer position.

40. A vacuum molding apparatus for pulp products comprising:

molding platen means for providing a plurality of forming mold attachment sites to receive one or more forming molds, and for introducing wet pulp material to said forming molds to mold formed products;

air pressure source means operably connected to said plurality of forming mold attachment sites of said molding platen means for selectively creating an air pressure at said forming mold attachment sites, including means for creating a negative air pressure at said forming mold attachment sites to attract said wet pulp material to said forming molds;

control means connected between said air pressure source means and said plurality of forming mold attachment sites for individually and differentially controlling duration and volume flow rate of air applied to said forming mold attachment sites by said air pressure of said air pressure source means depending on characteristics of the formed product at each said forming mold attachment site;

transfer platen means for providing a plurality of transfer mold attachment sites to receive one or more transfer molds corresponding to said forming molds, and for transferring said formed products from said forming molds for subsequent processing; and drying means situated proximate to the transfer platen means for receiving said formed products from said transfer platen means and for drying said formed products;

said drying means comprising conveyor means for carrying said formed products through said drying means and a plurality of baffle control means for selectively directing drying air flow to provide different air flow volumes to different parts of the conveyor to accommodate different formed product configurations.

41. The apparatus of claim 40 wherein said drying means comprises a plurality of sequentially arranged air drying stages through which the formed products pass, with the air drying stages having independently controllable air flow volumes.

42. The apparatus of claim 40 wherein vertical positioning of said conveyor means is adjustable to vary a distance which said formed products drop from said transfer molds to said conveyor means.

43. The apparatus of claim 42 wherein said vertical positioning adjustment of said conveyor means is automatically controlled by a programmable logic controller.

* * * * *